United States Patent [19]

Montag et al.

[11] 4,406,935

[45] Sep. 27, 1983

[54] DOOR JAMB SWITCH

[75] Inventors: John H. Montag, Warren; Gary B. Zulauf, Pinckney, both of Mich.

[73] Assignee: Gulf & Western Manufacturing Company, Southfield, Mich.

[21] Appl. No.: 331,123

[22] Filed: Dec. 15, 1981

[51] Int. Cl.[3] ..... H01H 3/16

[52] U.S. Cl. ..... 200/61.82; 200/159 R; 200/302

[58] Field of Search ..... 200/61.78, 61.81, 61.82, 200/159 R, 159 A, 159 B, 302, 340

[56] References Cited

U.S. PATENT DOCUMENTS 2,921,155 1/1960 Basso ..... 200/61.76 X 3,586,810 6/1971 Brown ..... 200/302

*Primary Examiner*—A. T. Grimley

*Assistant Examiner*—Morris Ginsburg

*Attorney, Agent, or Firm*—Body, Vickers & Daniels

[57] ABSTRACT

In a door jamb switch of the type having a first member adapted to be fixedly secured onto a door jamb of a motor vehicle, a switch element having a first actuated condition and a second actuated condition and a plunger mounted for reciprocation in the fixed first member along an axis between a first, door opened, position with the switch element in its first actuated condition and a second, door closed, position with the switch element in the second actuated condition there is provided an improvement. The plunger carries a generally cylindrical water deflector sleeve concentric with the movable axis of the plunger and telescoped around the plunger mounting sleeve. This deflector sleeve is secured onto the plunger at its outer end and is free standing at its inner end so that the sleeve reciprocates over the open end of the mounting sleeve with movement of the plunger to prevent the flow of water into the open end of the mounting sleeve.

15 Claims, 7 Drawing Figures

FIG. 1
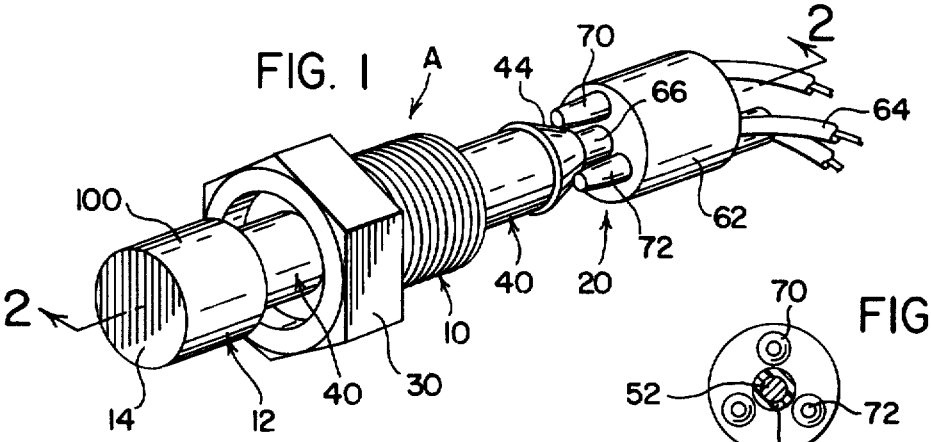
FIG. 4
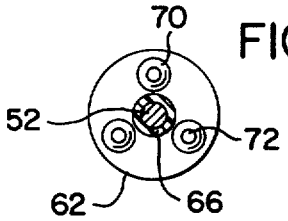
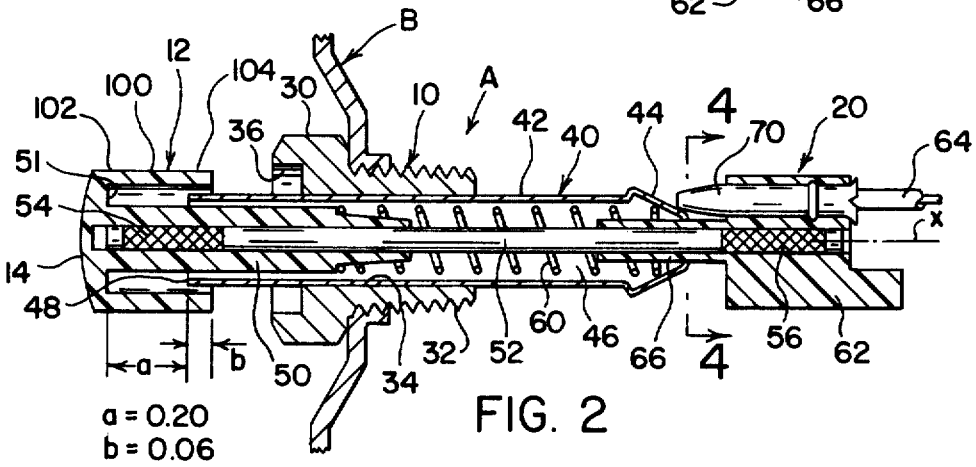
FIG. 2
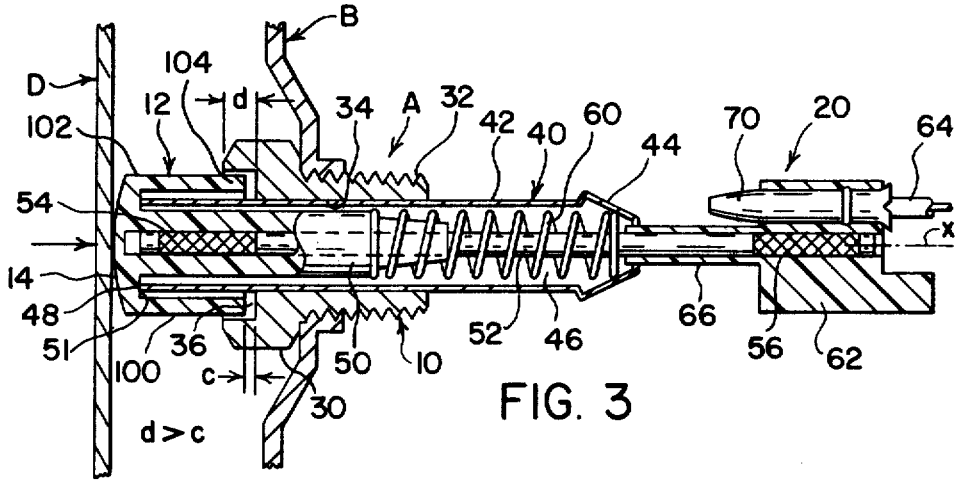
FIG. 3

DOOR JAMB SWITCH

The present invention relates to the art of mechanically actuated switches and more particularly to an improved switch to be used on a door jamb.

INCORPORATION BY REFERENCE

U.S. Pat. Nos. 3,249,727 and 3,251,971 are incorporated by reference herein as background information on self-adjusting door jamb switches of the general type to which the present invention is particularly applicable.

BACKGROUND OF INVENTION

In motor vehicles, it is common practice to employ one or more door jamb switches. These switches include a switch element that is shifted between switching conditions when the vehicle door is opened and closed. An outwardly extending plunger is extended when the door is opened and is depressed when the door is closed. Due to dimensional variations the distance between the inner face of the door and its matching door jamb is different from door-to-door. To compensate for this condition, self-adjusting door jamb switches, as shown generally in U.S. Pat. Nos. 3,249,727 and 3,251,971, have been commonly employed by the automotive industry. These switches have a collapsible plunger or other arrangement which self-adjusts upon the initial closing of the door against the jamb after the switch has been assembled. Thereafter, the switch operates in accordance with this initial adjustment. These self-adjusting door jamb switches each have a plunger formed from plastic material which is reciprocated in a metal mounting sleeve fixed onto the door jamb.

When the door of a vehicle is closed, moisture often accumulates and moves along the jamb surface. There is a tendency for such moisture to work its way into the plunger mounting sleeve. This moisture can ultimately cause corrosion, arcing and other damaging conditions at the switch element. Several attempts have been made to overcome the tendency of water to migrate or flow into the mounting sleeve of the adjustable door jamb switch and cause damage over long periods. The most common arrangement is the use of a plastic, flexible boot around the plunger to provide a physical seal between the movable plunger and the inner workings of the door jamb switch. This boot is repeatedly flexed during operation of its door jamb switch and is expensive and can deteriorate over long periods of time. The cost factor is magnified by the volume of switches employed in the automotive industry. Thus, there is a need for a less expensive arrangement or structure for preventing migration of moisture into the switch portion of the door jamb switch used in the automotive industry. More particularly, there is a need for an arrangement to prevent this moisture migration in self-adjusting type of door jamb switches so that the arrangement for preventing migration does not affect the self-adjusting feature of the door jamb switch and/or require additional manipulative and assembly processes.

THE INVENTION

In accordance with the present invention there is provided an improvement in a door jamb switch of the type having a first member adapted to be fixedly secured onto a door jamb, a switch element having a first actuated condition and a second actuated condition and a plunger mounted for reciprocation into the first fixed member along an axis between a first (door opened) position with the switch element in the first condition and a second (door closed) position with the switch element in the second actuated condition. This type of switch has included a plunger having an outwardly extended knob with a protrusion adapted to be engaged by a door movable with respect to the door jamb and having a surface facing the door jamb and generally orthogonal to the reciprocal axis of the plunger. This surface engages the open end of the cylindrical plunger mounting sleeve. The improvement in this type of switch is the provision of a generally cylindrical water or moisture deflector sleeve concentric with the operating axis of the plunger and surrounding the metal plunger mounting sleeve at its opened end. This deflector sleeve includes a first end integrally molded as a part of the plastic knob and joined to the plunger adjacent the previously mentioned orthogonal surface. A second open end of the deflector sleeve extends toward the first fixed member on the door jamb. The length of this cylindrical deflector sleeve between the first and second ends allows movement of the knob and plunger into the second (door closed) position and surrounds the mounting sleeve in this door closed position so that water is deflected by the sleeve and does not have direct access to the mounting sleeve in which the plunger reciprocates. This position of the sleeve inhibits and substantially prevents ingress of moisture into the inner workings of the door jamb switch for the purpose of improving the life and operability.

In accordance with another aspect of the invention, the previously mentioned moisture or water deflector sleeve surrounds the open end of the mounting sleeve even when the plunger and knob are in the first (door opened) position. Thus, for the short time that the door is opened, the deflector sleeve inhibits contamination by moisture accumulating on the door jamb. This can be beneficial when the door is opened during rain and snow conditions.

In accordance with still a further aspect of the invention, the inwardmost end of the plastic deflector sleeve, which is free standing, extends into a recess around the metal mounting sleeve when the door jamb switch is in the door closed position. Thus, the deflector sleeve extends into the fixed member of the switch when the door is closed to further prevent direct access to the interior of the switch by moisture flowing down and accumulating on the door jamb.

The primary object of the present invention is the provision of an improved door jamb switch, which switch substantially inhibits inward flow of moisture without the use of auxiliary components, such as flexible, separately assembled boots.

Another object of the present invention is the provision of an improved door jamb switch, as defined above, which switch includes a moisture deflector sleeve formed integrally with the plunger. Also, the deflector sleeve surrounds the plunger mounting sleeve to prevent direct ingress of moisture from the door jamb into the switch.

Another object of the present invention is the provision of a door jamb switch, as defined above, which door jamb switch has a moisture deflector that does not substantially increase the manufacturing cost, assembly cost and/or component cost of the door jamb switch.

Still a further object of the present invention is the provision of an arrangement for preventing liquid ingress into a door jamb switch, which arrangement is particularly applicable and useable in a self-adjusting type of door jamb switch commonly used in the automotive field. Such switches use slidable extending components which can be difficult to seal.

A further object of the present invention is the provision of an improved plunger for an adjustable door jamb switch, which plunger incorporates an arrangement for inhibiting and/or preventing moisture flow from the door jamb area into the switch itself.

These and other objects and advantages will become apparent from the following description taken together with the accompanying drawings as defined in the next section.

BRIEF DESCRIPTION OF DRAWINGS

The following drawings are incorporated in this disclosure:

FIG. 1 is a pictorial view illustrating the preferred embodiment of the invention;

FIG. 2 is a slightly enlarged cross-sectional view taken generally along line 2—2 of FIG. 1 and showing the door jamb portion onto which the invention is mounted;

FIG. 3 is a cross-sectional view as shown in FIG. 2 with the invention in the door closed position;

FIG. 4 is a cross-sectional view taken generally along line 4—4 of FIG. 2; and, FIGS. 5, 6 and 7 show the self-adjusting feature of the preferred embodiment wherein initial closing of the door sets the door jamb switch position with respect to the door jamb itself. The initial position is shown in FIG. 5. The position shown in FIG. 6 is an intermediate position. The normal operating position is shown in FIG. 7.

DISCLOSURE

Figure 5:
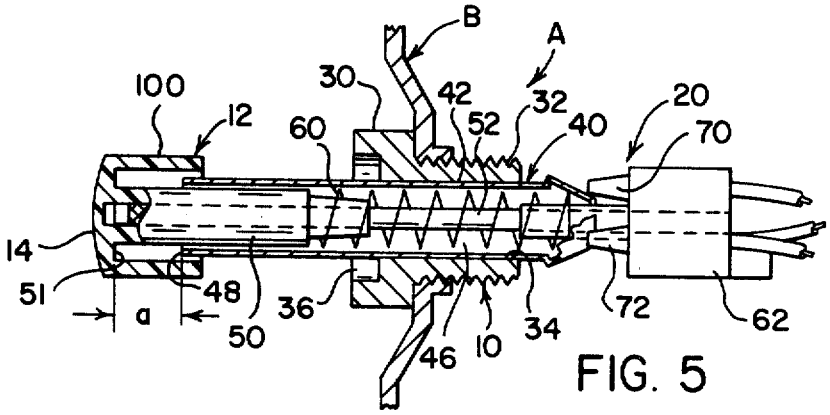

Referring now to the drawings wherein the showings are for the purpose of illustrating a preferred embodiment of the invention only and not for the purpose of limiting same, door jamb switch A includes a first member, or nut, 10 threadably mounted onto a standard door jamb B and a plastic plunger 12 having an outwardly extending knob 14 adapted to be engaged by vehicle door D in accordance with standard practice. A switching unit or element 20 is located at the end of plunger 12 and is adapted to be moved between a door opened position, as shown in FIG. 2, wherein the switch is closed and a door closed position, as shown in FIG. 3, wherein the switch is opened. Fixed nut 10 of switch A includes a hex wrench receiving head 30 and a threaded shank 32 adapted to be threaded into an aperture on door jamb B. A cylindrical inner bore 34 is adapted to receive and hold by friction the metal mounting sleeve 40 of plunger 12. Outward facing, cylindrical recess 36 has a depth d and surrounds sleeve 40 on the operating axis x of plunger 12. Mounting sleeve 40 is generally cylindrical in shape and is formed from an electrically conductive material, such as sheet brass, and includes an outer cylindrical surface 42 adapted to frictionally engage bore 34 of nut 10 to hold sleeve 40 in the adjusted reciprocated position shown in FIGS. 2, 3 and 7. Inner end 44 of sleeve 40 is contoured to provide a first contact for the electrical circuit controlled by the operation of switch A. The details of this circuit are well known and are not a part of the present invention. Sleeve 40 is drawn, rolled or otherwise shaped from sheet metal into a cylindrical element having an inner cavity 46 to receive plunger 12 as it is reciprocated between its two operative positions.

Referring now more particularly to plunger 12, this plunger includes a plastic molded body 50 reciprocally mounted within cavity 46 and has, at its outer end, knob 14. This knob has a rearwardly facing abutment or surface 51 which is used in the self-adjusting feature of the switch employed in the preferred embodiment of the invention. Metal shaft 52 extends into body 50 and is held from rotation and translation by knurled portion 54. Shaft 52 can be assembled into the body 50 or the body can be molded around knurled end 54 of the shaft. This shaft extends along the operating axis of the plunger and is surrounded by biasing spring 60 that forces plunger 12 and knob 14 into the outermost position, as shown in FIG. 2. At the opposite end of shaft 52 there is provided terminal block 62 secured onto shaft 52 at knurled portion 56. Appropriate wires 64 extend outwardly from block 62 which is molded from an insulating material, such as plastic of any appropriate type. Block 62 surrounds shaft 52 and has a length so that the end of boss 66 extends into sleeve 40 even though the switch is opened as shown in FIG. 3. Three contacts, two of which are shown as contacts 70, 72, are equally spaced around contact portion 44 of sleeve 40. These contacts are elongated and are molded into insulating block 62. Movement of shaft 52 between the positions shown in FIGS. 2 and 3 shifts block 62 to selectively open and close electrical circuits defined by contacts on block 62 and contact 44 of sleeve 40.

Figure 6:
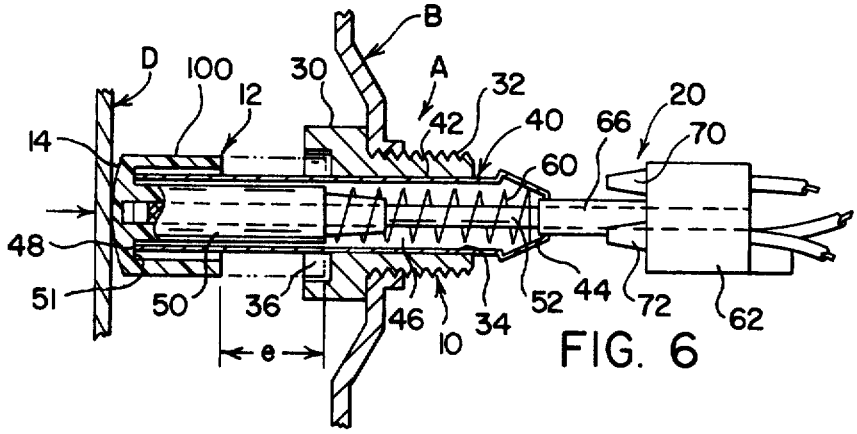
Figure 7:
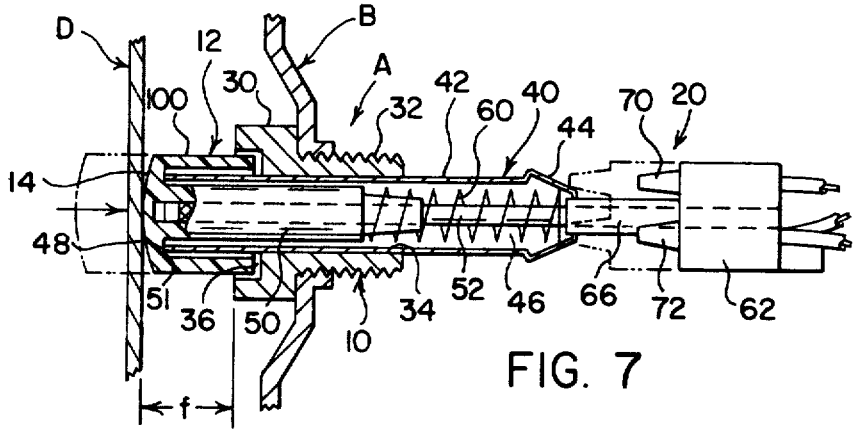

As so far described, the switch A does not differ substantially from the previously used self-adjusting door jamb switch. This previously used switch was assembled onto jamb B as shown in FIGS. 5–7. With sleeve 40 protruding outwardly, nut 30 is bolted into an aperture of door jamb B. Sleeve 40 protrudes outwardly beyond its normal operating position. Knob 14 is biased outward by spring 60. When door D is closed against door jamb B, spring 60 collapses since it had a low spring constant compared to the functional gripping force between sleeve 40 and bore 34. Consequently, spring 60 collapses by less than the force necessary to slide sleeve 40 into bore 34. When inwardly facing surface 51 of knob 14 engages the outermost end of sleeve 40, the sleeve is driven into nut 30, as shown in FIG. 6. At the final inward position of door D, mounting sleeve 40 is in the position shown in FIG. 7. Thereafter, sleeve 40 stays in this self-adjusted position which is determined by the tolerance between the closed position of door D and the door jamb B. Thereafter, plunger 12 is operated by knob 14 between the door opened position shown in FIG. 2 and the door closed position shown in FIG. 3. This is shown schematically in FIG. 7.

In accordance with the present invention, knob 14 has an integrally molded water or moisture deflector sleeve 100 having a forward end 102 and a back end 104. End 102 is integral with plunger 12 at a joint adjacent surface 51. End 104 is free standing and faces nut 30 so that it can be shifted into recess 36, as shown in FIG. 3, when door D is closed. Sleeve 100 is formed from relatively rigid plastic material and is self-supporting. This deflector sleeve has a length a+b, as shown in FIG. 2. In the inwardmost position, as shown in FIG. 3, a spacing c is maintained between open, rear end 104 of sleeve 100 and the lowermost surface of recess 36. This lower surface of recess 36 is at a depth d. In accordance with the preferred embodiment of the present invention, the recess depth d is substantially greater than spacing c.

Spacing c is variable according to the previously mentioned spacing of door D from jamb B after the door is closed. Distance c is maintained so that the lower wall of recess 36 does not affect the operation of switch A. When the door is then opened after sleeve 40 has been self-adjusted, the length a+b of sleeve 100 is greater than the spacing of open end 48 from surface 51. This is shown in FIG. 2 wherein spacing of surface 51 from end 48 is distance a that is controlled by the allowable movement of block 62. The overlap is distance b. With these dimensions, sleeve 100 maintains its overlapping relationship with the open end 48 of sleeve 40 irrespective of the door position. This prevents water from splashing or migrating into the chamber or cavity 46 even during the time that the door is opened. When the door is closed, surface 51 generally touches end 48 of sleeve 40. This does not form a tight seal. Over many years of use a gap may develop at this junction. Moisture can not flow into the area around sleeve 40 when the door is closed as shown in FIG. 3. Deflector sleeve 100 causes the moisture to flow around switch A.

Referring again to FIG. 6, the distance e is self-adjustable according to the ultimate closed position of door D with respect to jamb B. When the door is closed, as shown in FIG. 7, there is a spacing f from the door to the face of fixed nut 30. This spacing is adjusted so that the length of deflector sleeve 100 causes the sleeve to extend substantially into recess 36 for prevention of moisture flow around sleeve 40 and into the end 48 of the sleeve during long term use of switch A.

Having thus described the invention, the following is claimed:

1. In a self-adjusting door jamb switch having a first member adapted to be fixedly secured onto a door jamb, a cylindrical mounting sleeve through and in frictional engagement with said first member, said sleeve having a longitudinal axis and an opened end, a switch element having at least two contacts and a first actuated condition and a second actuated condition, and a plunger within said mounting sleeve, concentric with and movable along the axis of said mounting sleeve between a first, door opened, position with said switch element in said first actuated condition and a second, door closed, position with said switch element in said second actuated condition, wherein said plunger supports one of said contacts and includes an outwardly extending knob with a protrusion adapted to be engaged by a door movable with respect to said jamb, and a surface facing said open end of said cylindrical mounting sleeve, said surface being generally orthogonal to said axis for covering said opened end of said sleeve when said plunger is in said door closed position, the improvement comprising: a generally cylindrical water deflector sleeve concentric with said axis and telescoped around said mounting sleeve at said opened end, said deflector sleeve having a first end secured to said knob adjacent said orthogonal surface, a second end extending toward said first member and a length between said first and second ends allowing movement in unison of said knob and plunger with said contact into said second position.

2. The improvement as defined in claim 1 wherein said deflector sleeve and knob are integral.

3. The improvement as defined in claim 2 wherein said length is selected to allow said deflector sleeve to surround said opened end of said mounting sleeve when said plunger and knob are in said first position.

4. The improvement as defined in claim 3 including an outwardly facing recess in said first member and surrounding said mounting sleeve and said length is selected to cause said second end of said deflector sleeve to protrude into said recess when said plunger and knob are in said second, door closed, position.

5. The improvement as defined in claim 4 wherein said switch element includes two relatively movable contacts and means for mounting one of said contacts for movement with said plunger and knob.

6. The improvement as defined in claim 2 wherein said knob and deflector sleeve are separate parts of an integrally molded plastic component.

7. The improvement as defined in claim 1 wherein said length is selected to allow said deflector sleeve to surround said opened end of said mounting sleeve when said plunger and knob are in said first position.

8. The improvement as defined in claim 7 including an outwardly facing recess in said first member and surrounding said mounting sleeve and said length is selected to cause said second end of said deflector sleeve to protrude into said recess when said plunger and knob are in said second, door closed, position.

9. The improvement as defined in claim 1 including an outwardly facing recess in said first member and surrounding said mounting sleeve and said length is selected to cause said second end of said deflector sleeve to protrude into said recess when said plunger and knob are in said second, door closed, position.

10. The improvement as defined in claim 1 wherein said knob and deflector sleeve are separate parts of an integrally molded plastic component.

11. The improvement as defined in claim 1 wherein said mounting sleeve is adjustably mounted in said first member for movement along said axis by said surface engaging said opened end of said mounting sleeve when said door is initially moved to a closed position.

12. The improvement as defined in claim 2 wherein said mounting sleeve is adjustably mounted in said first member for movement along said axis by said surface engaging said opened end of said mounting sleeve when said door is initially moved to a closed position.

13. The improvement as defined in claim 3 wherein said mounting sleeve is adjustably mounted in said first member for movement along said axis by said surface engaging said opened end of said mounting sleeve when said door is initially moved to a closed position.

14. The improvement as defined in claim 13 including an outwardly facing recess in said first member and surrounding said mounting sleeve and said length is selected to cause said second end of said deflector sleeve to protrude into said recess when said plunger and knob are in said second, door closed, position.

15. The improvement as defined in claim 6 wherein said mounting sleeve is adjustably mounted in said first member for movement along said axis by said surface engaging said opened end of said mounting sleeve when said door is initially moved to a closed position.

* * * * *